US009681779B2

(12) United States Patent
Babikian et al.

(10) Patent No.: US 9,681,779 B2
(45) Date of Patent: Jun. 20, 2017

(54) DISPENSER

(71) Applicant: BOBRICK WASHROOM EQUIPMENT, INC., North Hollywood, CA (US)

(72) Inventors: Dikran Babikian, Glendale, CA (US); Raffi Mekhitarian, Shadow Hills, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 0 days.

(21) Appl. No.: 14/452,440

(22) Filed: Aug. 5, 2014

(65) Prior Publication Data

US 2015/0034680 A1 Feb. 5, 2015

Related U.S. Application Data

(60) Provisional application No. 61/862,478, filed on Aug. 5, 2013, provisional application No. 61/947,936, filed on Mar. 4, 2014.

(51) Int. Cl.

| | |
|---|---|
| ***B67D 7/06*** | (2010.01) |
| ***A47K 5/12*** | (2006.01) |
| ***A47K 5/14*** | (2006.01) |
| *B05B 11/00* | (2006.01) |
| *B05B 15/00* | (2006.01) |

(52) U.S. Cl.

CPC ..... *A47K 5/1211* (2013.01); *A47K 5/14* (2013.01); *B05B 11/0097* (2013.01); *B05B 11/3047* (2013.01); *B05B 11/3001* (2013.01); *B05B 15/005* (2013.01); *B05B 15/008* (2013.01)

(58) Field of Classification Search

CPC ..... B05B 11/3001; B05B 11/3047; B05B 11/3023; B05B 11/0097; A47K 5/1121; A47K 5/14; A47K 5/1211

USPC ..... 222/321.6–321.9, 460–462, 383.1, 180, 222/181.2, 173; 141/18, 286, 363–365, (Continued)

(56) References Cited

U.S. PATENT DOCUMENTS 5,226,566 A * 7/1993 Brandenburg ..... A47K 5/1205 222/180

5,305,810 A 4/1994 Meshberg (Continued)

FOREIGN PATENT DOCUMENTS

JP 2009-165762 A 7/2009

WO WO 2010/048576 A3 4/2010

OTHER PUBLICATIONS

PCT Search Report and Written Opinion mailed Nov. 19, 2014, for Application No. PCT/US2014/049821; 10 Pages.

(Continued)

*Primary Examiner* — Paul R Durand

*Assistant Examiner* — Andrew P Bainbridge

(74) *Attorney, Agent, or Firm* — Lewis Roca Rothgerber Christie LLP

(57) ABSTRACT

A dispenser for dispensing a fluid. The dispenser includes a shank for penetrating a countertop opening and having a filling end. A reservoir is in communication with the shank and is coupled to the shank and extends below a lower end of the shank, such that when a fluid is provided at the filling end of the shank it will flow into the reservoir through the shank along a path. The dispenser also includes a pump and a spout coupled to the pump extending above the shank.

22 Claims, 7 Drawing Sheets

(58) Field of Classification Search
USPC ..... 141/29, 285, 290, 298–300, 303, 141/307–309, 325; 4/675–676
See application file for complete search history.

(56) References Cited

U.S. PATENT DOCUMENTS

| | | | | |
|---|---|---|---|---|
| 5,476,197 | A * | 12/1995 | Lawrence | A47K 5/1211 222/180 |
| 6,119,901 | A * | 9/2000 | Hanna | A47K 5/1205 222/321.1 |
| 6,641,000 | B2 * | 11/2003 | Lange | B67D 7/04 137/565.01 |
| 7,527,174 | B2 * | 5/2009 | Meehan | A47K 1/08 141/332 |
| 8,544,698 | B2 * | 10/2013 | Ciavarella | A47K 5/14 222/145.5 |
| 8,991,657 | B2 | 3/2015 | Ciavarella et al. | |
| 9,004,318 | B2 | 4/2015 | Kodama et al. | |
| 9,072,412 | B2 | 7/2015 | Ciavarella et al. | |
| 9,073,066 | B2 | 7/2015 | Banks et al. | |
| 2002/0005417 | A1 * | 1/2002 | De Laforcade | B05B 11/0018 222/481 |
| 2003/0071074 | A1 * | 4/2003 | Redman | A47K 5/12 222/321.9 |
| 2003/0160071 | A1 * | 8/2003 | Moore | B05B 11/0059 222/321.7 |
| 2005/0127105 | A1 * | 6/2005 | Kay | B05B 9/042 222/211 |
| 2005/0155988 | A1 | 7/2005 | Meehan et al. | |
| 2007/0023454 | A1 * | 2/2007 | Ophardt | A47K 5/14 222/190 |
| 2008/0237266 | A1 * | 10/2008 | Ciavarella | A47K 5/14 222/190 |
| 2012/0267396 | A1 * | 10/2012 | Quinlan, Jr. | A47K 5/14 222/190 |
| 2015/0053722 | A1 | 2/2015 | Ciavarella et al. | |
| 2015/0078117 | A1 | 3/2015 | Santagiuliana | |
| 2015/0136808 | A1 | 5/2015 | Ciavarella et al. | |
| 2015/0144661 | A1 | 5/2015 | Tepas et al. | |
| 2015/0202645 | A1 | 7/2015 | Tepas et al. | |
| 2015/0223647 | A1 | 8/2015 | Brouwer | |
| 2015/0224454 | A1 | 8/2015 | Albertz et al. | |

OTHER PUBLICATIONS

Spartan; *Lite 'n Foamy Counter Mount Dispenser*; (Brochure); Maumee, OH; Date Unknown; 2 pages.

* cited by examiner 64
67
69
74
70
102
18
104
72
16
72
17
25
19
23
62
14
81
60
32
80
58
100
15
82
56
20
10
84
30
46
28
22
26
37
34
61
24
40
42
38
63
12
50
54

DISPENSER

CROSS-REFERENCE TO RELATED APPLICATIONS

This application claims priority to and the benefit of Provisional Application No. 61/862,478, filed on Aug. 5, 2013, and Provisional Application No. 61/947,936, filed on Mar. 4, 2014, the entire disclosure of both of which are incorporated herein by reference.

BACKGROUND

Fluid dispensers such as liquid soap or foam dispensers are mounted on countertops in bathrooms such as commercial bathrooms. The dispensers included a reservoir for holding the fluid to dispensed and mounted below the countertop and a dispensing spout above the countertop. A pump is plumbed in the dispenser for pumping the fluid when the spout is pressed. In order to refill the reservoir, the plumbing connections to the pump must be disconnected and the reservoir must be disconnected from the spout and removed to a location where it can be refilled. This is a time consuming process.

SUMMARY

In an example embodiment a dispenser for dispensing a fluid is provided. The dispenser includes a shank for penetrating a countertop opening and having a filling end, a reservoir in communication with the shank and coupled to the shank and extending below a lower end of the shank, such that when a fluid is provided at the filling end of the shank it will flow into the reservoir through the shank along a path, a pump having a vent venting to a location at or above the filling end, and a spout coupled to the pump extending above the shank. In one example embodiment a cap is over the filling end, and the spout extends above the cap. In another example embodiment, the dispenser also includes a conduit coupled to the vent and extending to the location at or above the filling end. In yet another example embodiment, the vent is an opening on the pump, and the opening is located at the location at or above the filling end. In a further example embodiment, the filling end defines a funnel.

In yet a further example embodiment, a dispenser is provided for dispensing a fluid. The dispenser includes a shank for penetrating a countertop, a reservoir in communication with the shank and coupled to the shank and extending below the shank, a perforated cage below the shank, a pump at least partly in the cage, and a spout coupled to the pump extending above the shank. In one example embodiment, the dispenser also includes a cap over at least a portion of the shank, and the spout extends above the cap. In a further example embodiment, pushing on the spout activates the pump. In yet a further example embodiment, the dispenser further includes a supply tube coupled to the cage and extending into the reservoir for supplying fluid from the reservoir to the pump. In another example embodiment, the spout penetrates the cap. In another example embodiment, the reservoir is filled from an upper portion of the shank. In yet another example embodiment, the upper portion of the shank defines a funnel. In one example embodiment, the pump vents at a location at or above the upper end of the shank.

In another example embodiment, a dispenser for dispensing a fluid is provided. The dispenser includes a shank penetrating a countertop opening having a filling end, a reservoir in communication with the shank and coupled to the shank below the upper surface of the countertop, such when a fluid is provided at the filling end of the shank above the countertop it will flow into the reservoir through the shank along a path, a pump having a vent venting to a location at or above the filling end, and a spout coupled to the pump extending above the upper surface. In one example embodiment a cap is over the filling end, and the spout extends above the cap. In yet another example embodiment, the dispenser also includes a conduit coupled to the vent and extending to the location at or above the filling end. In a further example embodiment, the vent is an opening on the pump, and the opening is located at the location at or above the filling end. In yet a further example embodiment, the filling end defines a funnel.

In another example embodiment, a dispenser is provided for dispensing a fluid. The dispenser includes a shank penetrating a countertop opening and having an upper end, a portion extending above an upper surface of the countertop and a portion extending below a lower surface of the countertop, a reservoir in communication with the shank and coupled to the shank and extending below the shank and below the upper surface of the countertop, a perforated cage below the countertop upper surface, and a pump at least partly in the cage, a spout coupled to the pump extending above the upper surface. In one example embodiment the dispenser also includes a cap over the shank portion extending above the upper surface of the countertop, such that the spout extends above the cap. In a further example embodiment, pushing on the spout activates the pump. In yet a further example embodiment, the dispenser also includes a supply tube coupled to the cage and extending into the reservoir for supplying fluid from the reservoir to the pump. In another example embodiment, the spout penetrates the cap. In yet another example embodiment, the pump is below the upper surface. In a further example embodiment, the reservoir is fellable from above the upper surface through the shank. In yet a further example embodiment, the shank includes a conical surface extending above the upper surface of the countertop defining a funnel. In one example embodiment, the pump vents at a location at or above the upper end of the shank.

DETAILED DESCRIPTION

Figure 1:
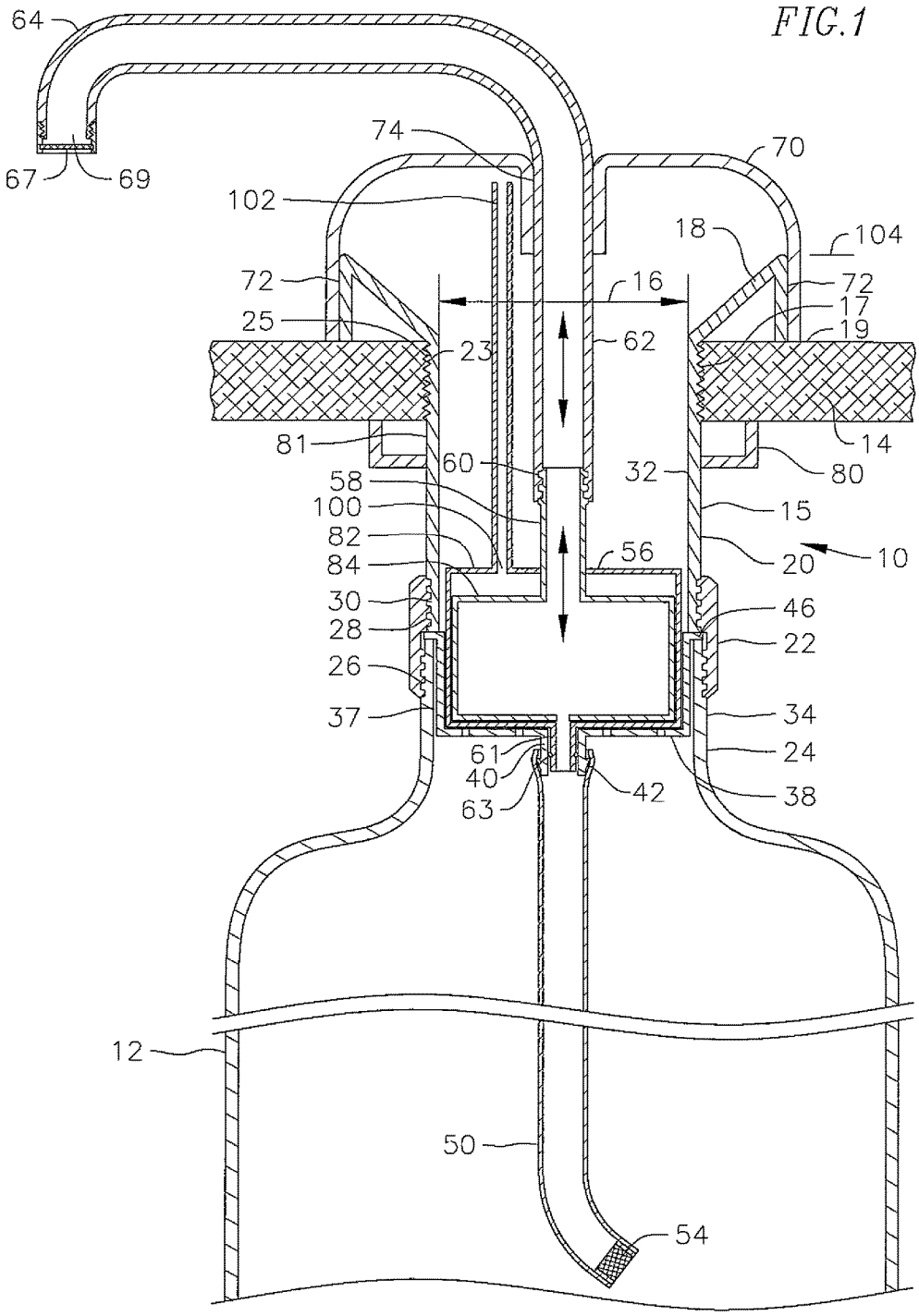
FIG. 1 is a partial cross-sectional view of an example embodiment dispenser.

In an example embodiment, a fluid dispenser 10, such as a liquid dispenser, as for example a liquid soap or a liquid foam dispenser is provided, as for example shown in FIGS.

1 and 2. In an example embodiment, the dispenser includes a reservoir 12, such as a reservoir which is mounted below a countertop 14. A shank 15, as for example a cylindrical shank having a one inch inner surface diameter 16, is mounted through an appropriately sized opening 17 on the countertop. Other diameter shanks may be used. In an example embodiment, the shank includes a funnel portion, such as a conical portion, 18 extending above an upper surface 19 of the countertop and a cylindrical portion 20 extending below the upper surface 19 of the countertop. The funnel portion defines a filling end 21 through which the reservoir may be filled with the fluid. In one example embodiment, the two portions are formed integrally. In another example embodiment, the two portions are coupled together by any known means. For example, in one example embodiment, the conical portion may be threaded onto the cylindrical portion. In an example embodiment, the cylindrical portion includes an outer thread 23 that are threaded into a thread 25 formed in the opening 17 on the countertop.

In an example embodiment, the reservoir is coupled to the shank using a coupler 22 such as a coupling nut. In an example embodiment, the reservoir includes an upper portion, as for example a neck portion 24 including outer threads 26. Outer threads 28 are also provided on at least a lower portion 30 of the shank. The coupling nut threads on the outer threads of the shank, as well as the outer threads of the reservoir for coupling the reservoir to the shank, such that the inner surface of the shank is aligned with an inner surface of the reservoir.

Figure 2:
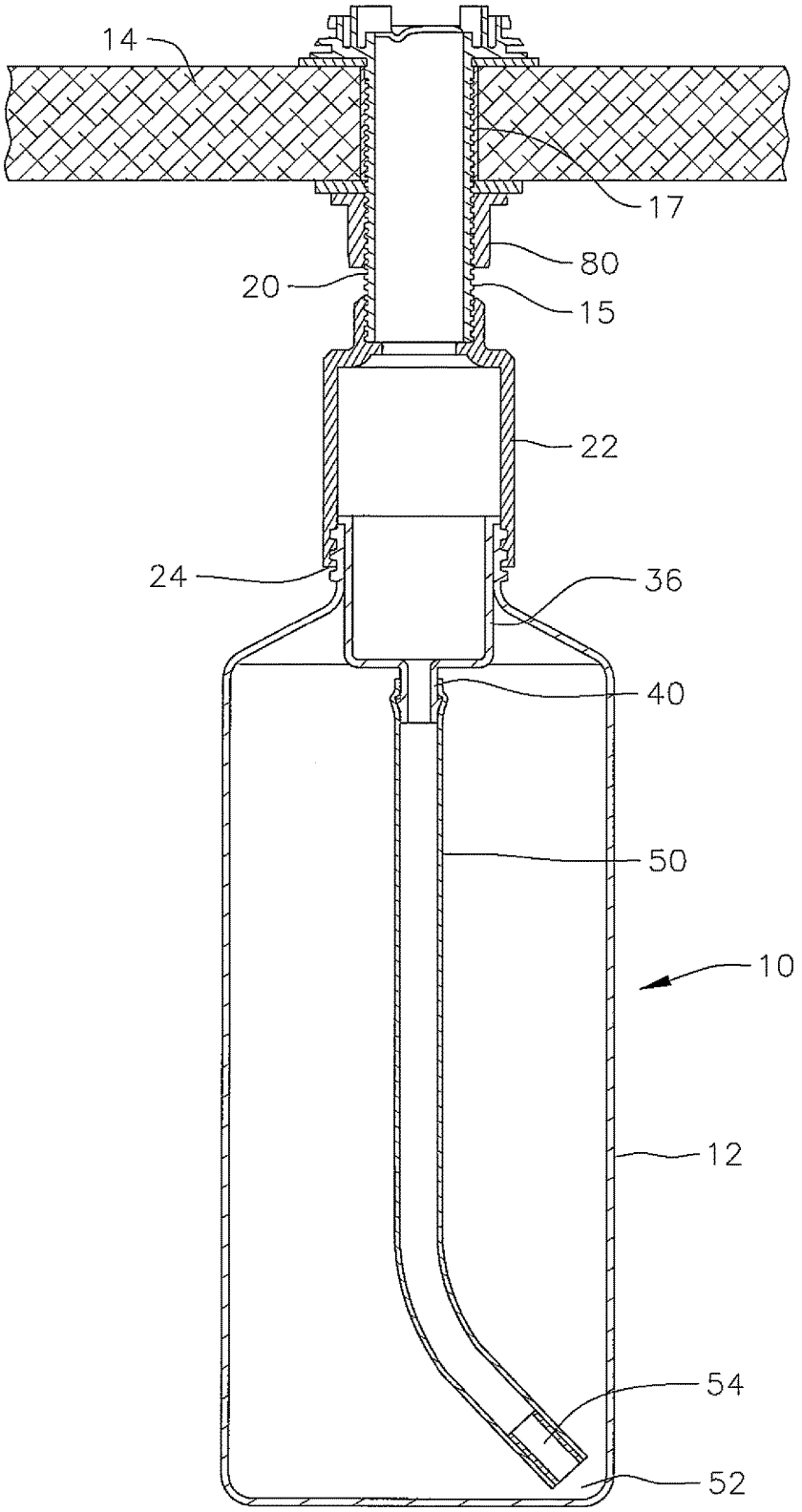
FIG. 2 is a partial cross-sectional view of another example embodiment dispenser.
Figure 3:
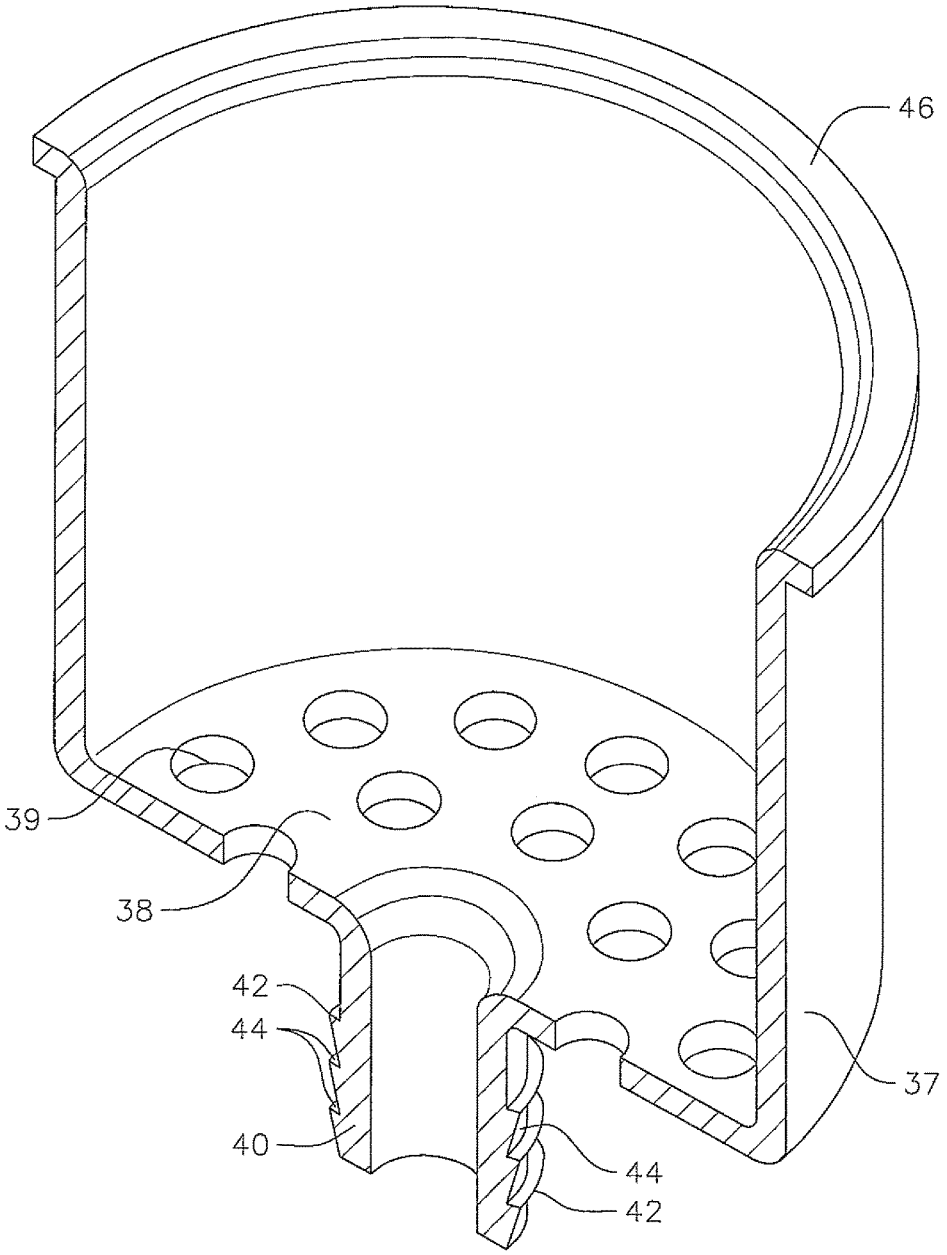
FIG. 3 is a cut-away perspective view of a cage incorporated in example embodiment dispensers.
Figure 4:
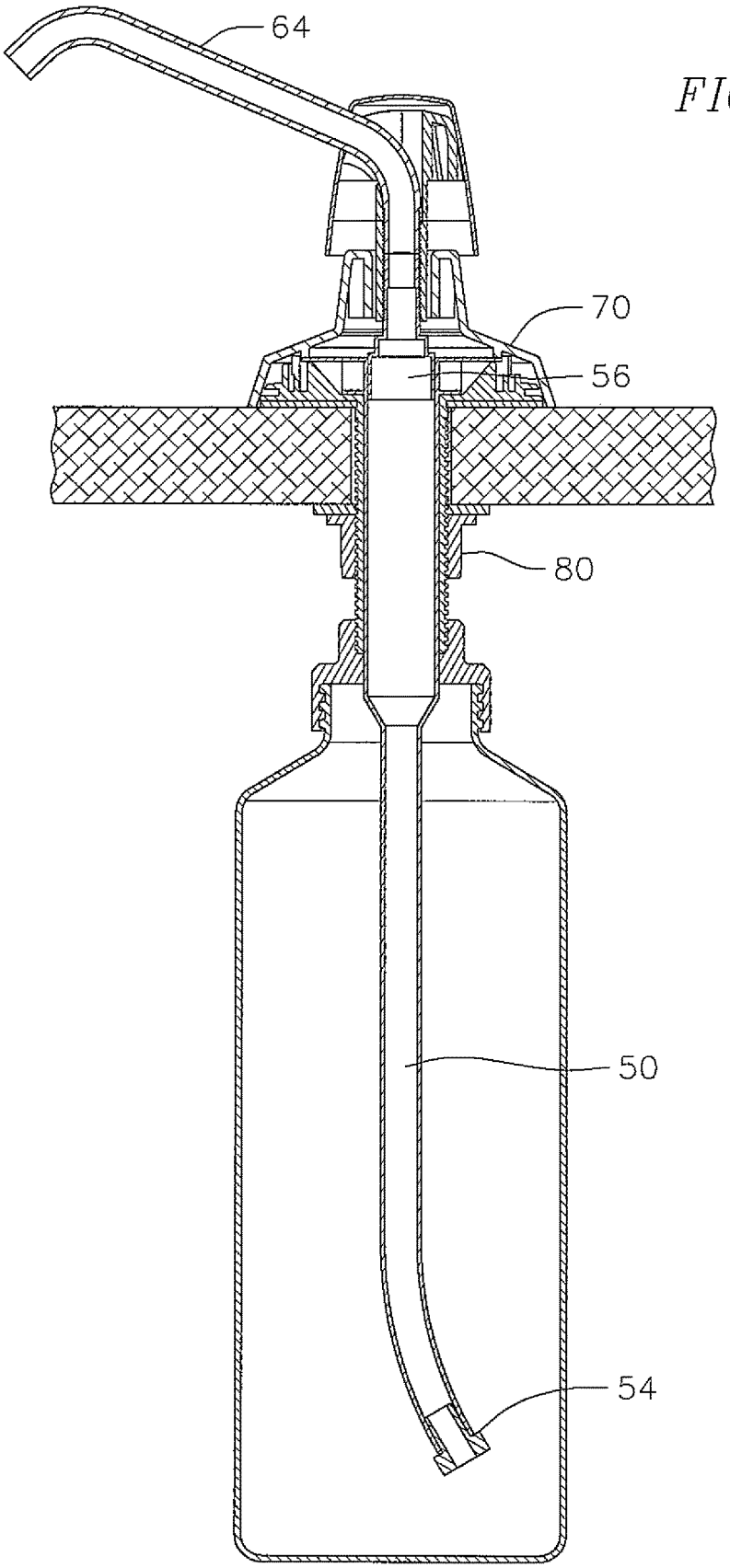
FIG. 4 is a cross-sectional view of yet another example embodiment dispenser.

In one example embodiment, the inner surface 32 of the cylindrical portion of the shank has a diameter that is the same as the diameter of the inner surface 34 of the neck portion of the reservoir. In a further example embodiment, a cage 36 having perforations 39 is mounted between the shank and the reservoir (FIGS. 1, 2 and 3). In an example embodiment, the cage has a cylindrical wall 37 extending from a base 38. In an example embodiment, the perforations 39 are formed through the base. A tubular portion 40 having defining a conduit extends from the base 38 of the cage. In an example embodiment, a tooth or teeth 42 may be defined on an outer surface of the tubular member. In an example embodiment, the teeth are annular teeth defining grooves 44 there-between. An annular lip 46 extends radially outward from an upper end of the cage cylindrical wall 37 opposite the base. In an example embodiment, the annular lip is sandwiched between the shank and the reservoir neck as for example shown in FIG. 1. The coupling member 22 is then threaded onto the threads 28 on the outer surface of the shank cylindrical portion and on the threads 26 formed on outer surface of the neck 24, clamping the reservoir neck and the shank against the annular lip for the holding the cage in position. In another example embodiment, the annular lip may rest on the reservoir neck portion 24, as for example shown in FIG. 2. As can be seen in both FIGS. 1 and 2, the cage is supported by the neck portion 24 and more specifically by the annular lip resting against the neck portion. In other example embodiments, the reservoir may be formed with an annular step for supporting the cage by resting the annular lip of the cage on such annular step. In other example embodiments, other means may be used to attach the cage to either or both the reservoir (e.g., the bottle) and the shank. For the example the cage may be threaded to an inner surface of the reservoir or shank. In other example embodiments, the cage may be integrally formed with the reservoir or with the shank.

A supply tube 50 is fitted over the tubular portion 40 extending from the cage. In an example embodiment, the supply tube is made from a plastic material. The supply tube may be made from other materials. In an example embodiment, the supply tube is pushed over the annular teeth 42 of the tubular member so that it is held in place by such teeth. In an example embodiment, the supply tube extends to a bottom portion 52 or the bottom of the reservoir for supplying the fluid or liquid in the reservoir to a pump. In one example embodiment, a mesh, portion or other filtering medium 54 may be placed at the end of the supply tube opposite the tubular portion 40 for filtering out any unwanted particles from the fluid, e.g., the liquid in the reservoir. In one example embodiment, the mesh is a two-part mesh mixer that aids in the formation of foam from a liquid in the reservoir.

In an example embodiment, the pump such as a foam pump 56 is positioned within the cage. A typical foam pump is one produced by Ophardt Hygiene. A foam pump takes liquid, or liquid not fully converted to foam, from the reservoir and converts it to foam. The pump in some embodiments may take foam from the reservoir and pump it. In other example embodiments, the pump is not a foam pump and may be any pump capable of pumping a fluid. A pump, as for example the foam pump 56 in an example embodiment has a tubular outlet 58. The tubular outlet may also include a tooth or teeth, such as an annular teeth, or annular threads, 60 extending from its outer surface. In an example embodiment, the pump has an inlet tube 61 that is fitted within the tubular portion 40 of the cage. In one example embodiment, an O-ring seal 63 is fitted between an outer surface of the inlet tube 61 and an inner surface of the conduit defined by the tubular portion 40 for sealing the space between the outer surface of the inlet tube 61 and the inner surface of tubular portion 40 of the cage.

In an example embodiment, a tube 62 is positioned over the tubular outlet 58. The tube 62 may be slid over the teeth 60 or may be threaded to the threads 60 on the outer surface of the outlet tube. The teeth 60 help retain the tube 62 in position over tubular outlet 58. In an example embodiment, the tube 62 is a rigid tube that is connected with a spout 64. The rigid tube may be formed from a rigid plastic material or other materials that provide for sufficient rigidity. In an example embodiment, the tube 62 is integrally formed with a spout. When the spout is pushed down, the spout pushes down on the tube 62, which in turns pushes down on the pump for pumping the foam (or fluid) through the tube 62 to the spout 64. In an example embodiment, a mixing mesh 67, such as for example a two-part mixing mesh may be provided at the outlet, or proximate the outlet 69, of the spout for assisting in forming foam or for further foaming any foam pumped by the pump 56 to the spout.

In an example embodiment, a cap 70 is provided that extends over and covers the conical portion (e.g., the funnel portion) 18 of the shank. In an example embodiment, the cap may be threaded to an outer portion of the funnel portion of the shank. In an example embodiment, a tubular surface 72 extends from the funnel portion of the shank having threads formed from its outer surface. Threads are formed from an inner surface of the cap and are threaded onto the outer surface of such cylindrical portion 72. In another example embodiment, the cap may be press fitted over the conical portion or may be directly removably attached to the countertop or to the conical portion using known methods. The cap covers the portion of the shank extending above the countertop 14. The tube 62 extending to the spout penetrates an opening 74 formed through the cap such that the spout 64 extends outside of and over the cap 70. In an example embodiment, the tube 62 can slide relative to the opening 74 of the cap.

In an example embodiment, a mounting nut 80 is provided which may be coupled or threaded to an outer surface portion 81 of the cylindrical portion 20 of the shank. As the mounting nut is threaded on the outer portion of the cylindrical portion of the nut, it pulls the shank downward through the opening 17 on the countertop such that the conical portion 18, or another member coupled to the conical portion of the shank, engages the upper surface 19 of the countertop such that the countertop is clamped between the mounting nut and the conical portion of the shank such another member.

Typically, a foam pump 56 includes an outer member 82 and an inner member 84 within the outer member that moves relative to the outer member and includes an inner spring (not shown) for moving the inner member relative to the outer member to its original position after being pushed. In an example embodiment, the pump tubular outlet 58 extends from the inner member through the outer member. In this regard when the spout is pushed downward it pushes the inner member against the spring force. Once the spout is let go, the spring forces the inner member and thus, the spout, upward to their original position.

In an example embodiment, the cage, including the pump, is positioned such that they are located below the countertop. In this regard, the profile of the dispenser extending above the countertop is reduced. In addition, with the example embodiment, the spout including the pump which is connected to the spout via the tube 62 may be rotated by rotating the spout relative to the cage while the dispenser is mounted on a countertop and is operational.

As can be seen, with an example embodiment dispenser, if the pump fails, it can be easily replaced without having to replace the spout and any other part of the dispenser. All that is required is that it gets disconnected from the tube 62 and removed from the cage 36. Moreover, with example embodiments, the reservoir may be filled from the top of the countertop through the shank without having to disconnect the reservoir from the countertop. In the example embodiment shown in FIG. 1, cap 70 is removed, the spout with pump are then removed by pulling upward on the spout, and the reservoir is filled with a liquid soap through the conical portion of the shank which defines a funnel. The liquid soap will then penetrate the perforations 39 on the base of the cage 36 and flow into the reservoir. In an example embodiment when pulling up on the spout, the spout with pump is removed from the dispenser as a unit. After the filling is completed, the shank with pump is slid back into position, such that the pump rests within the cage and the cap 70 is re-attached.

Figure 5:
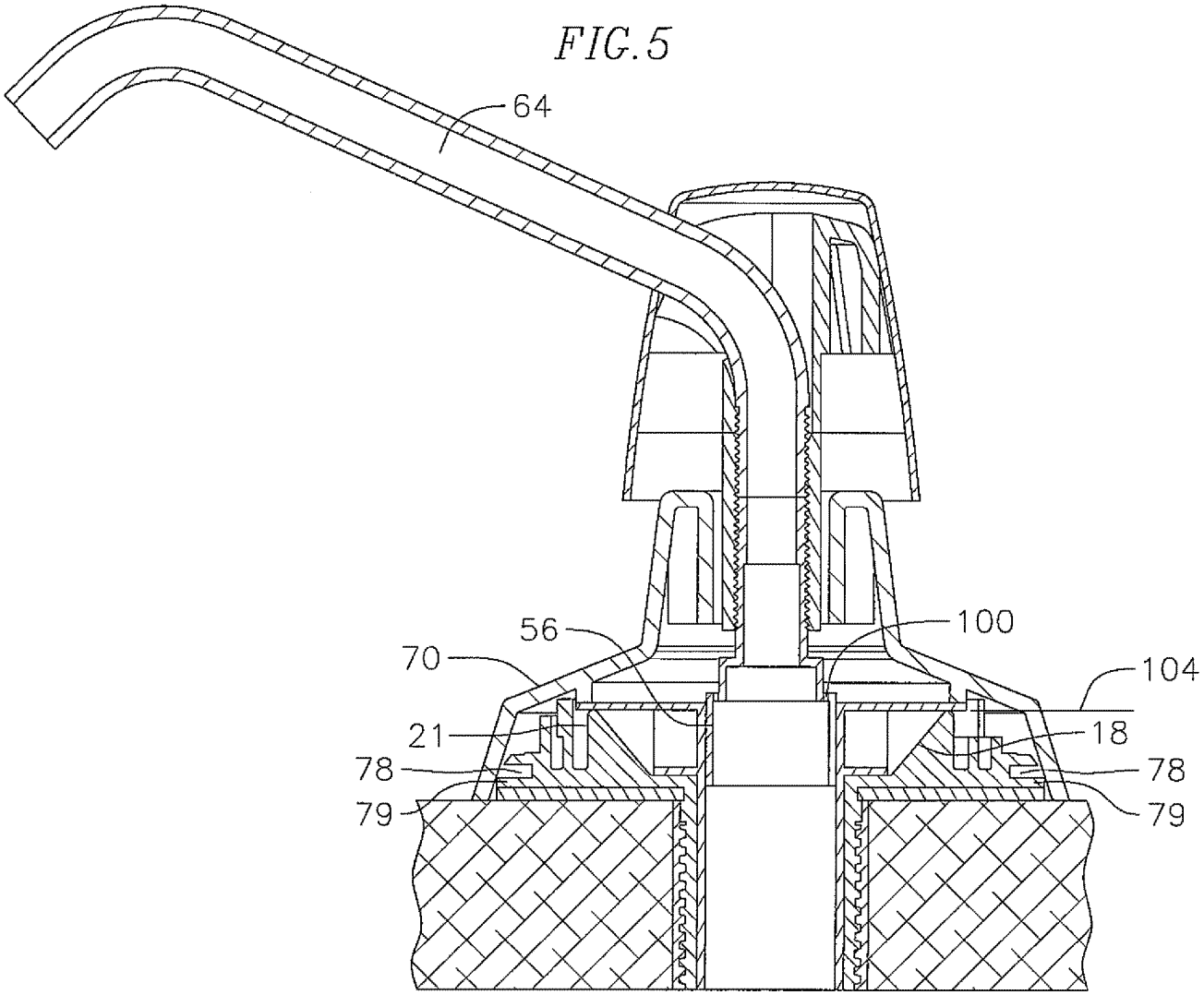
FIG. 5 is an enlarged cross-sectional view of an upper portion of the dispenser shown in FIG. 4.

Many pumps, such as pump 56 have an air vent 100 (FIGS. 1 and 5). If a liquid soap was to enter the air vent, it may prevent the pump from working properly. Thus, in an example embodiment, the level of the liquid soap should be maintained below the level of vent 100. In one example embodiment, a conduit 102 may be coupled to the air vent so that the air vent vents through conduit 102 to a level high enough not to be occupied by the liquid soap. Such a location in one example is a level 104 above the highest level of the filling end 21. In this regard, even if the reservoir is over-filled with liquid soap, the liquid soap would never go above level 104 and as such, will not block, or otherwise interfere, the air vent.

Figure 6:
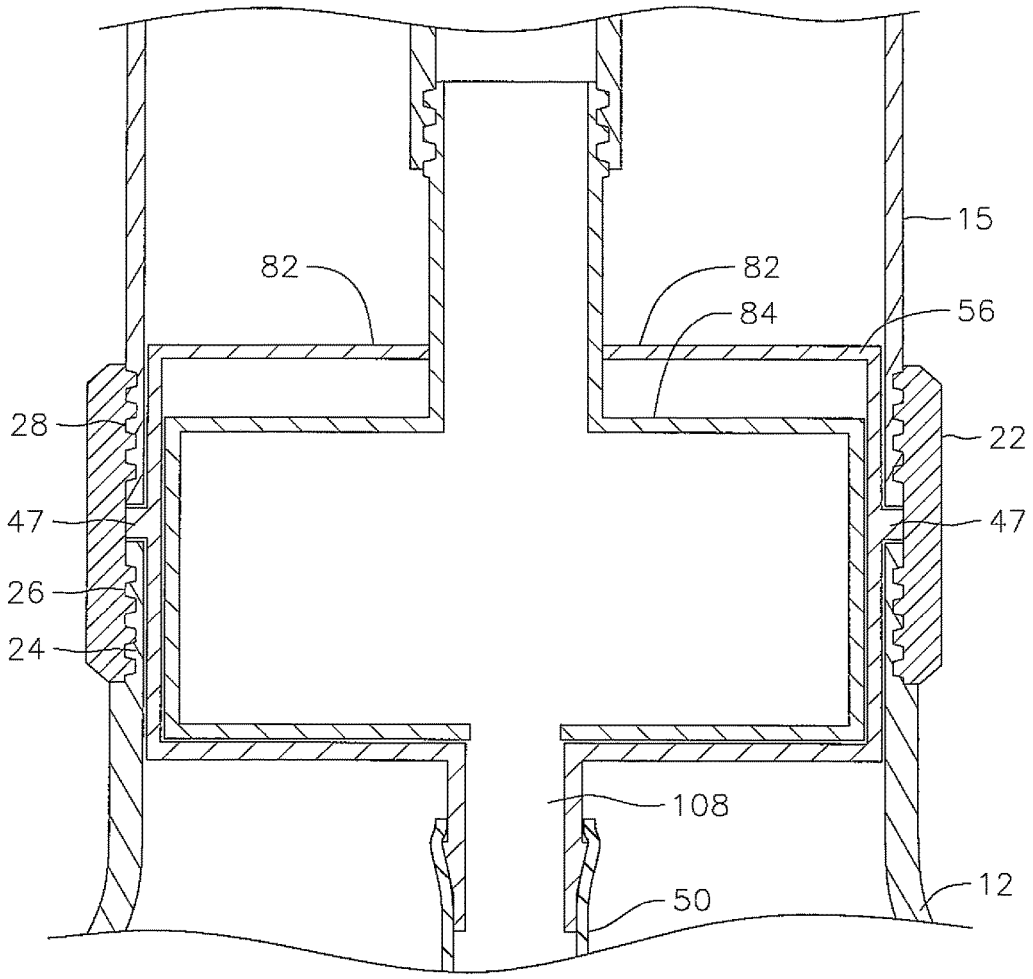
FIG. 6 is a partial cross-sectional view of a section of another example embodiment dispenser.

In another example embodiment, a lip 47 extends radially outward from the outer member 82 of the pump 56, in lieu of lip 46. In this regard, a cage 36 is not required as the pump lip is sandwiched between the shank 15 and the reservoir neck 24, and may rest against the reservoir neck (FIG. 6). With this example embodiment, the supply tube 50 is connected directly into an outlet 108 the pump, as for example shown in FIG. 6.

Figure 7:
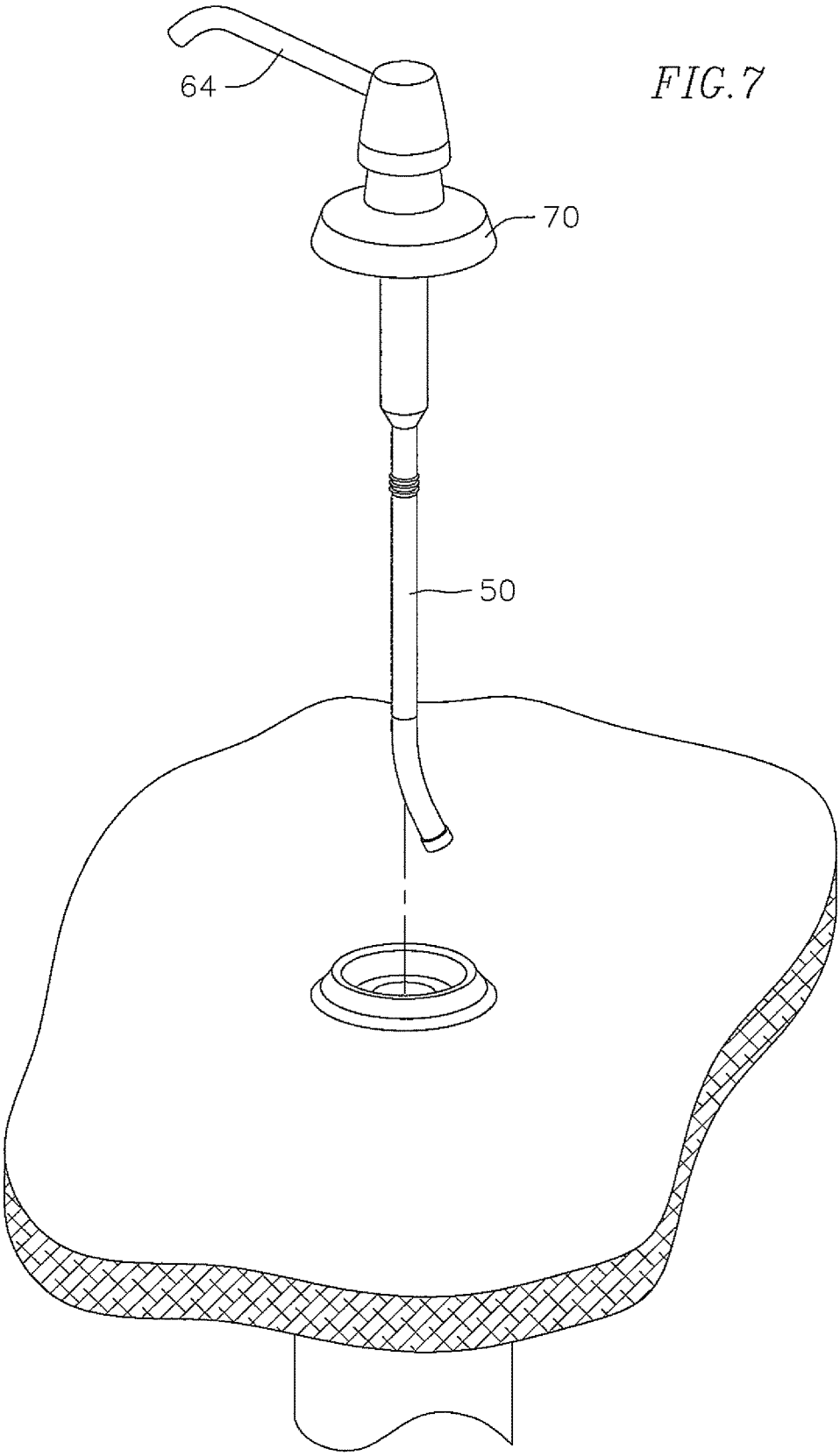
FIG. 7 is an exploded view showing the removal of the spout, pump and supply tube as a single unit in an example embodiment dispenser.

In yet another example embodiment, the pump is mounted so that the vent 100 is at a location such that even if the reservoir is over-filled with liquid, the vent is not submerged in the liquid. For example, as shown in FIG. 5, the pump is mounted such that the air vent is above the highest level 104 of the filling end 21. With this example embodiment, the spout 64 along with the cap 70 and the pump including the supply tube 50 are removed as a single unit from the reservoir by decoupling the cap 70 from the filling end (e.g. from the funnel portion 18), as for example shown in FIG. 7. With this example embodiment, a cage may not be required. In some embodiments, the cap may be snap fitted onto the filling end or may be threadedly coupled to the filling end. For example, as shown in FIG. 5 the cap may have internal projections 78 that are received in complementary depressions 79 on the filling allowing the cap to be snap fitted on the filling end. Alternatively, the projections are formed on the filling end and the depressions are formed on the interior of the cap. In any of the aforementioned example embodiments, a mesh, such as a mesh mixer 54 may be coupled to a lower end of the supply tube.

While the present disclosure has been described with respect to a limited number of embodiments, those skilled in the art, having benefit of this disclosure, will appreciate that other embodiments and modifications can be devised which do not materially depart from the scope of the invention as disclosed herein. For example, the "tubular" members, "cylindrical" members or the "tubes" described herein do not have to be circular in cross-section. They can have other geometric shapes in cross-section such elliptical, rectangular, etc. All such embodiments and modifications are intended to be included within the scope of this disclosure as defined in the following claims. For example, the filling end may have shapes other than conical. For example, it may be cylindrical or polygonal.

What is claimed is:

1. A dispenser for dispensing a fluid comprising:

a shank for penetrating a countertop opening and having a filling end for extending above an upper surface of the countertop;

a reservoir in communication with the shank and coupled to the shank and extending below a lower end of the shank, wherein when the fluid is provided at the filling end of the shank said fluid will flow into the reservoir through said shank along a path;

a pump for extending entirely below the countertop upper surface;

a vent conduit extending from the pump within the shank to a location to at or above at the filing end of the shank and venting to said location, wherein the vent conduit is within the shank at the filling end; and a spout coupled to said pump by at least a supply conduit extending within the shank, wherein the spout extends above the shank, wherein the fluid from the pump travels through said at least a supply conduit to the spout.

2. The dispenser of claim 1, further comprising a cap over said filling end, wherein said spout extends above said cap.

3. The dispenser of claim 1, wherein the filling end defines a funnel.

4. The dispenser of claim 1, wherein the pump is a pump for extending entirely below a lower surface of the countertop opposite the countertop upper surface.

5. A dispenser for dispensing a fluid comprising:

a shank penetrating a countertop opening and having an upper end, a portion extending above an upper surface of the countertop and a portion extending below a lower surface of the countertop;

a reservoir in communication with the shank and coupled to the shank and extending below the shank and below the upper surface of the countertop;

a perforated cage comprising a base comprising at least one perforation for allowing fluid to flow through said at least one perforation to said reservoir, said perforated cage being below said countertop upper surface;

a pump at least partly in said cage and resting against said cage;

supply tube connected to the cage and extending into the reservoir for supplying fluid from the reservoir to said pump; and a spout coupled to said pump extending above the upper surface, wherein lifting of said pump causes the pump to lift from said cage while the supply tube remains connected to the cage.

6. A dispenser for dispensing a fluid comprising:

a shank for penetrating a countertop;

a reservoir in communication with the shank and coupled to the shank and extending below the shank;

a perforated cage comprising a base comprising at least one perforation for allowing fluid to flow through said at least one perforation to said reservoir, said perforated cage being below said shank;

a pump at least partly in said cage and resting against said cage;

supply tube connected to the cage and extending into the reservoir for supplying fluid from the reservoir to said pump; and a spout coupled to said pump extending above the shank, wherein lifting of said pump causes the pump to lift from said cage while the supply tube remains connected to the cage.

7. The dispenser of claim 6, further comprising a cap over at least a portion of said shank; wherein said spout extends above said cap.

8. The dispenser of claim 6, wherein pushing on the spout activates said pump.

9. The dispenser of claim 6, wherein the reservoir is filled from an upper portion of the shank.

10. The dispenser of claim 9, wherein the upper portion of said shank defines a funnel.

11. The dispenser of claim 6, wherein the pump vents at a location at or above an upper end of said shank.

12. A dispenser for dispensing a fluid comprising:

a shank penetrating a countertop opening and having a filling end above an upper surface of said countertop;

a reservoir in communication with the shank and coupled to the shank below said upper surface of the countertop, wherein when the fluid is provided at the filling end of the shank above the countertop said fluid will flow into the reservoir through said shank along a path;

a pump entirely below the countertop upper surface;

a vent conduit extending from the pump and within the shank to a location at or above the filing end of the shank and venting to said location, wherein the vent conduit is within the shank at the filling end; and a spout coupled to said pump by at least a supply conduit extending within the shank, wherein the spout extends above the shank, wherein the fluid from the pump travels through said at least a supply conduit to the spout.

13. The dispenser of claim 12, further comprising a cap over said filling end, wherein said spout extends above said cap.

14. The dispenser of claim 12, wherein the filling end defines a funnel.

15. The dispenser of claim 5, wherein the pump is entirely below a lower surface of the countertop opposite the countertop upper surface.

16. The dispenser of claim 15, further comprising a cap over the shank portion extending above the upper surface of the countertop, wherein said spout extends above said cap.

17. The dispenser of claim 15, wherein pushing on the spout activates said pump.

18. The dispenser of claim 15, wherein the pump is below said lower surface.

19. The dispenser of claim 15, wherein the reservoir is fillable from above the upper surface through the shank.

20. The dispenser of claim 19, wherein said shank comprises a conical surface extending above the upper surface of the countertop defining a funnel.

21. The dispenser of claim 15, wherein the pump vents at a location at or above said upper end of said shank.

22. The dispenser of claim 21, further comprising a vent conduit extending from the pump and within the shank to a location at or above said upper end of said shank for venting to said location.

* * * * *